US010757998B2

(12) United States Patent
Krumbeck

(10) Patent No.: US 10,757,998 B2
(45) Date of Patent: Sep. 1, 2020

(54) CHILDREN'S SKI BOOT WITH IMPROVED WALKING FUNCTION

(71) Applicant: MARKER Deutschland GmbH, Penzberg (DE)

(72) Inventor: Markus Krumbeck, Farchant (DE)

(73) Assignee: Marker Deutschland GmbH, Penzberg (DE)

( * ) Notice: Subject to any disclaimer, the term of this patent is extended or adjusted under 35 U.S.C. 154(b) by 17 days.

(21) Appl. No.: 15/923,530

(22) Filed: Mar. 16, 2018

(65) Prior Publication Data

US 2018/0263331 A1 Sep. 20, 2018

(30) Foreign Application Priority Data

Mar. 17, 2017 (EP) ..... 17161715

(51) Int. Cl.
*A43B 5/00* (2006.01)
*A43B 5/04* (2006.01)
*A43B 3/30* (2006.01)

(52) U.S. Cl.
CPC ..... *A43B 5/0419* (2013.01); *A43B 5/047* (2013.01); *A43B 5/0417* (2013.01); *A43B 5/0421* (2013.01); *A43B 5/0427* (2013.01); *A43B 3/30* (2013.01)

(58) Field of Classification Search
CPC .... A43B 5/0417; A43B 5/0419; A43B 5/0421
USPC ..... 36/117.3, 117.4
See application file for complete search history.

(56) References Cited

U.S. PATENT DOCUMENTS 3,363,342 A * 1/1968 Stohr ..... A43B 5/0417 36/117.3
4,351,120 A * 9/1982 Dalebout ..... A43B 5/0419 36/117.3
4,901,454 A * 2/1990 Walkhoff ..... A43B 3/0042 280/607
4,937,955 A * 7/1990 Bonaventure ..... A43B 5/0417 280/613
4,958,445 A * 9/1990 Brisco ..... A43B 5/0419 36/117.4

(Continued)

FOREIGN PATENT DOCUMENTS

EP 2829188 A1 1/2015

OTHER PUBLICATIONS

Office Action from EP App. No. 17 161 715.2, dated Apr. 9, 2020, 4 pages.

(Continued)

*Primary Examiner* — Marie D Bays
(74) *Attorney, Agent, or Firm* — Luedeka Neely Group, P.C.

(57) ABSTRACT

A ski boot, comprising a ski boot shell and a ski boot sole, wherein the ski boot sole comprises a front end of the ski boot sole, a rear end of the ski boot sole, a lower side of the sole and a free upper side of the sole via which the ski boot sole protrudes forwards, backwards and/or laterally beyond the ski boot shell, wherein the lower side of the sole comprises a first bearing region for placing upright on a bearing plate of a ski binding, and a second bearing region for walking without skis, wherein a width of the ski boot sole in the second bearing region is larger than a width of the ski boot sole in the first bearing region.

20 Claims, 3 Drawing Sheets

(56) References Cited

U.S. PATENT DOCUMENTS

Figure 1:
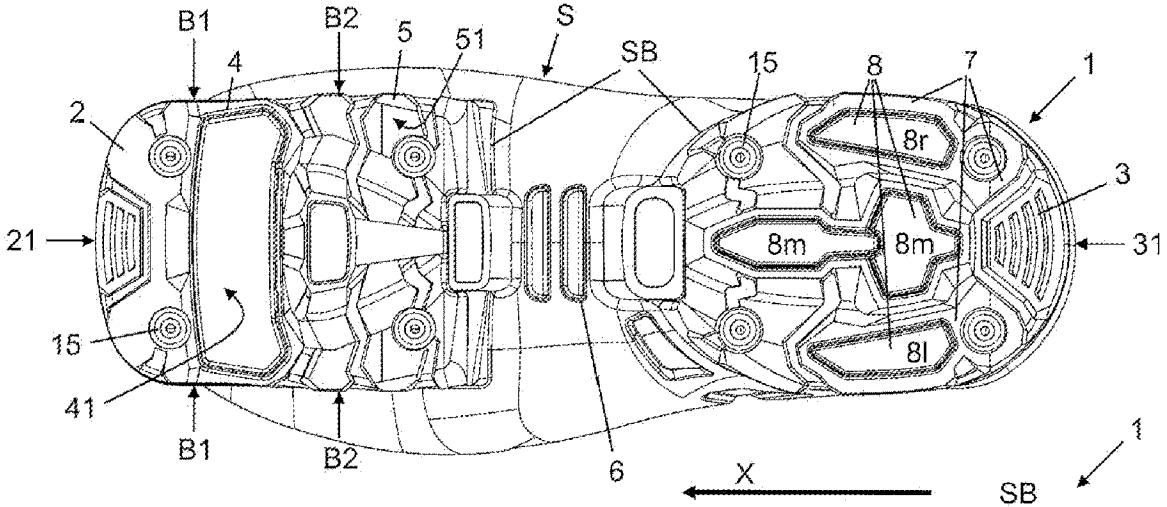

| | | | | |
|---|---|---|---|---|
| 6,286,855 | B1 * | 9/2001 | Paris | A43B 5/0417 280/608 |
| 6,402,183 | B1 | 6/2002 | Marmonier et al. | |
| 8,960,711 | B2 * | 2/2015 | Svensson | A43B 5/0421 280/636 |
| 9,265,300 | B2 * | 2/2016 | Svensson | A43B 5/0486 |
| 9,844,241 | B2 * | 12/2017 | Rosato | A43B 3/246 |
| 2008/0272577 | A1 * | 11/2008 | Kogler | A63C 9/20 280/615 |
| 2010/0313448 | A1 * | 12/2010 | Girard | A43B 5/0413 36/117.3 |
| 2011/0179680 | A1 * | 7/2011 | Miette | A43B 5/0411 36/30 R |
| 2013/0147160 | A1 * | 6/2013 | Svensson | A43B 5/0421 280/636 |
| 2013/0283643 | A1 * | 10/2013 | Rosato | A43B 3/246 36/117.3 |
| 2014/0115929 | A1 * | 5/2014 | Svensson | A43B 5/0486 36/117.3 |
| 2014/0115930 | A1 * | 5/2014 | Svensson | A43B 5/0411 36/117.3 |
| 2014/0137439 | A1 * | 5/2014 | Pegolo | A43B 1/0054 36/114 |

OTHER PUBLICATIONS

Extended European Search Report for EP Application No. 17161715.2, dated Sep. 1, 2017, 9 pages.

* cited by examiner

CHILDREN'S SKI BOOT WITH IMPROVED WALKING FUNCTION

This application claims the benefit of the earlier filing date of European patent application 17161715.2, filed Mar. 17, 2017.

The invention relates to a ski boot comprising a ski boot shell and a ski boot sole, wherein the ski boot sole comprises a front end of the ski boot sole, a rear end of the ski boot sole, a lower side of the sole and a free upper side of the sole via which the ski boot sole protrudes forwards, backwards and/or laterally beyond the ski boot shell. The lower side of the sole comprises a first bearing region, in which the ski boot is placed upright on a bearing plate of a ski binding while the ski binding is closed, and a second bearing region via which the ski boot is placed upright on a level area outside the ski binding for walking without skis, wherein a width of the ski boot sole as measured transverse to a longitudinal axis of the ski boot sole in the second bearing region is larger or wider than a width of the ski boot sole in the first bearing region. The ski boot is preferably a children's ski boot.

Children in particular often have the problem that they find it difficult to walk in ski boots which exhibit a relatively narrow outer sole. They can easily lose their balance, twist their ankle and hurt themselves or simply fall over. This can detract from the enjoyment and fun of skiing.

It would therefore be desirable to have a ski boot, in particular for children, which makes it easier to walk in the ski boot without skis and improves safety when walking.

This object is solved by the invention using the ski boot in accordance with Claim 1.

One aspect of the invention relates to a ski boot, in particular a ski boot for children, which comprises a ski boot shell and a ski boot sole which is connected to the ski boot shell. The ski boot shell can comprise one or more parts and preferably consists of a plastic. The plastic can be hard and therefore inelastic or relatively inelastic, or can at least comprise regions which exhibit an elasticity which facilitates walking, in particular when walking in the ski boot. If the ski boot or, respectively, the ski boot shell consists of multiple parts, the latter can be connected to each other via joints. The ski boot can also comprise closing elements in order to close the ski boot for skiing and walking, wherein the closing elements can close the ski boot more tightly in the skiing position than in the walking position.

The ski boot sole comprises a front end of the ski boot sole, a rear end of the ski boot sole, a lower side of the sole and a free upper side of the sole via which the ski boot sole protrudes forwards, backwards and/or laterally beyond the ski boot shell. The front and/or rear region of the ski boot sole can comprise pin receptacles, in order to be connected to pin bindings of a known type.

The ski boot sole comprises—in relation to a longitudinal direction of the ski boot—a portion for the toes and ball of the foot and a heel portion. When the ski boot is held in a ski binding, the ski boot is placed upright in a first bearing region of the portion for the toes and ball of the foot and in the heel portion, wherein it is placed upright on a front bearing plate of the ski binding in the first bearing region, and on a rear bearing area of the ski binding or on the ski in the heel region. The rear bearing area can for example be formed by another bearing plate of the ski binding. In the portion for the toes and ball of the foot, the lower side of the sole of the ski boot comprises a second bearing region which lies beneath the ball of the foot of the wearer of the ski boot. If the ski boot is detached from the ski binding and placed upright on a base plane, the ski boot contacts the base plane in the heel portion and in the second bearing region. The second bearing region preferably forms a rolling-off region in which the wearer of the ski boot can roll their foot off when walking without skis, following the natural walking movement.

A contact area facing away from the ski boot shell, via which the ski boot sole is placed on the base plane in the second bearing region, is wider than a contact area facing away from the ski boot shell, via which the first bearing region is placed on the bearing plate of the ski binding.

In advantageous embodiments, the ski boot sole can exhibit a width, in an upper vertical region of the second bearing region near the ski boot shell, which differs from the width of the contact area via which the ski boot is placed on a base plane in the second bearing region, wherein the contact area which lies on the base plane can in particular be wider than the upper vertical region.

The ski boot sole can then widen continuously from the ski boot shell up to the lower side of the sole in the second bearing region; the ski boot sole can however also comprise an upper vertical region having a constant width, starting at the ski boot shell, which then widens in one or more stages or continuously up to the lower side of the sole or the contact area in a lower-lying lower vertical region in the second bearing region. The height of the lower vertical region can for example correspond to the depth of a profile on the lower side of the sole.

In a plan view onto the lower side of the sole, the second bearing region or, respectively, at least the contact area of the second bearing region facing away from the ski boot shell can exhibit any shape. The outer sides which protrude beyond the normal width of the ski boot soles are preferably arcuate; other shapes are however also conceivable, such as for example rectangular, square or triangular, double-arcuate or S-shaped, etc.

The first bearing region is nearer to the front end of the sole in the longitudinal direction of the sole than the second bearing region. The first bearing region can also lie higher than the second bearing region when a ski boot is placed on the base plane outside the ski, i.e. the first bearing region can exhibit a larger vertical clear distance from the base plane on which the ski boot is placed than a partial region of the second bearing region which does not contact the base plane when merely placed upright and stationary.

According to a first aspect, at least the second bearing region is at least regionally curved, convexly in a direction away from the ski boot shell, in a direction transverse to the width of the sole, i.e. in the longitudinal direction of the ski boot from the front end to the rear end of the sole. In order to facilitate rolling off via the ball of the foot when walking without skis, the lower side of the sole can be bulged outwards, i.e. curved convexly downwards, away from the upper side of the sole in the longitudinal direction of the ski boot in the second bearing region. In advantageous embodiments, the contact area of the second bearing region, i.e. the area which rolls off on the base plane during a rolling-off movement when walking without skis, is advantageously round across the entire length of the contact area. In the longitudinal sections of the second bearing region, the curvature radius of the contact area can be constant across the entire length of the contact area. In alternative embodiments, the curvature radius can vary. The rolling-off movement is homogenised by a contact area which is round across the entire length and convexly curved downwards as viewed from the upper side of the sole. The convex curve can however in principle also exhibit a polygonal profile. The lower side of the second bearing region can then for example comprise a middle planar area region which drops off at its front and rear periphery via an edge and an oblique area region, respectively. If, as is preferred, downwardly protruding ribs or nubs or otherwise shaped protrusions are provided in the second bearing region, this applies to an enveloping area which is applied to the lower side of such protrusions and which then forms the contact area.

A concave or at least regionally concave curve of the second bearing region can be realised in the width direction. It is then possible for the lateral ends and/or side edges of the second bearing region to be provided with protrusions, such as for example ribs and/or nubs, which for example protrude downwards and are inclined outwards, for example obliquely, with respect to the respective side. Optionally, the contact area of the second bearing region can widen again under an applied load, by elastically deforming the lateral ends of the second bearing region which extend in the longitudinal direction of the sole.

Within the framework of the invention, the term "curved" includes contours which are round in at least one direction across the entire profile of the curve, and also shapes which are composed of straight segments or which comprise straight segments and arcuate portions.

The first bearing region and the second bearing region can be formed from an identical material and exhibit an identical hardness. In advantageous embodiments, however, at least the contact area of the first bearing region consists of a different material to the second bearing region. The material of at least the contact area of the first bearing region can have a greater hardness than the material of the second bearing region. Preferably, at least the contact area of the first bearing region comprises a hard component which exhibits a Shore D hardness of at least or more than 40, more preferably at least or more than 45 and particularly preferably at least or more than 50. The second bearing region can comprise a soft component which exhibits a Shore A hardness of preferably 60 to 90, more preferably 65 to 85 and particularly preferably 70 to 80.

The width of the ski boot sole or, respectively, the contact area of the ski boot sole in the first bearing region can exhibit a standard width of 62±2 mm. In the second bearing region, at least the contact area of the bearing region can have a width of at least 64 mm, preferably at least 65 mm or at least 66 mm and particularly preferably 67 mm, in its widest region. Widths exceeding 67 mm are less preferred but not excluded.

If, as already described above, the second bearing region is curved convexly in the longitudinal direction of the sole, and thus comprises an apical point, an apical line or an apical area, then the apical point, the apical line or the foremost edge of the apical area in the longitudinal direction of the sole can have a distance of 65 mm±10 mm, preferably 65 mm±8 mm and particularly preferably 65 mm±6 mm from the front end of the ski boot sole when a ski boot is placed upright on the base plane outside the ski. The distance can also measure 65 mm±4 mm or 65 mm±2 mm. These measurements apply in particular to a children's ski boot having an overall length of 217 mm, which corresponds to a shoe size of 17.

Since children's boots exhibit different lengths, the measurements specified can also exhibit different sizes. In general, it may be said that if the distance between the apical area or apical point or apical line and the front end of the ski is denoted by "a" and the length of the ski boot sole is denoted by "L", then "a" is 30%±10%, preferably 30%±5% and particularly preferably 30%±3% of "L". A ratio a/L would correspondingly then be 0.3±0.1, preferably 0.3±0.05 and particularly preferably 0.3±0.03.

The first bearing region likewise comprises a bearing point or bearing line or bearing area via which the ski boot held in the ski binding lies on the bearing area of the ski binding. This bearing point, bearing line or bearing area can exhibit a distance of 32 mm±8 mm, preferably 32 mm±5 mm and particularly preferably 32 mm+4/−2 mm from the front end of the boot sole. A perpendicular distance between the bearing point, the bearing line or the bearing area—extending parallel to the bearing plane—of the first bearing region and the base plane on which the ski boot is placed outside the ski can measure 5 mm±5 mm, preferably 5 mm±2 mm and particularly preferably 5 mm. A substantially perpendicular distance between the contact point of the first bearing region on the bearing plate of the ski binding and a plane which is spanned by a front free upper side of the sole can measure 17 mm±1.5 mm or 17 mm±1.2 mm or 17 mm+1/−0.5 mm or preferably 16.5 mm+1/−0.5 mm.

When a ski boot is placed on the base plane, a distance between the free upper side of the front end of the sole and the base plane can measure 23 mm±12 mm or 23 mm±7 mm or 23 mm±3 mm.

The ski boot sole can comprise a separate front sole pad, which comprises the first bearing area and the second bearing area, and a separate rear sole pad in the heel region. The front sole pad and the rear sole pad together can form a continuous ski boot sole or can instead be spaced from each other when they are arranged, for example fitted, on the ski boot. At least the front sole pad can be detachably connected to the ski boot or, respectively, the ski boot sole or lower side of the ski boot shell, such that the front sole pad can be exchanged. The front sole pad and/or the rear sole pad can instead however also be latterly injection-moulded onto a sole base connected to the ski boot shell in a plastic injection-moulding method or moulded together with a sole base when the sole base is moulded in a multi-component injection-moulding method. A fitted front sole pad and/or a fitted rear sole pad is/are however advantageous because it/they can be exchanged.

The ski boot can in particular be a children's ski boot, which should be marked with a "C" (children) in accordance with the relevant ski boot standards. One or more measurements of the ski boot, in particular its length and/or width and/or height measurements, can advantageously correspond to the version of DIN ISO 5355 applicable on the date of the application. The ski boot can in particular correspond, at least in relation to the ski boot sole, to ski boot type C of this internationally applicable standard with regard to one or more dimensions of the sole.

Another aspect of the invention relates to a sole pad for a ski boot, in particular a children's ski boot. The sole pad can be connected to the ski boot in a front region, the region for the toes and ball of the foot. The lower side of the sole pad comprises a first bearing region, via which the ski boot can be placed upright on a bearing area in a binding, and a second bearing region via which the ski boot can be placed upright on the substrate, for example a base plane, outside the ski. The second bearing region is used for walking in the ski boot without skis. A width of the sole pad transverse to a longitudinal direction of the sole is wider in the second bearing region than a width of the sole pad in the first bearing region; the second bearing region is preferably arranged beneath the ball of the foot of the ski boot user or near to the ball of the foot when the sole pad is connected to a ski boot. The lower side of the sole—which lies on the substrate—of the second bearing region can in particular be wider, as already described.

The sole pad can in particular be a sole pad and bearing regions comprising at least one of the features described in relation to the first aspect.

The first bearing region and/or the second bearing region can respectively exhibit a constant width across their overall length. Alternatively, the first bearing region or the second bearing region or both bearing regions can respectively exhibit a variable width as viewed across their length. When it is stated that a width of the second bearing region is larger than a width of the first bearing region, this means that if the width of the respective bearing region is variable, at least a maximum width of the second bearing region is larger than a maximum width of the first bearing region. In advantageous embodiments in which the width or a respective width is variable, a minimum width of the second bearing region can be larger than in particular a maximum width of the first bearing region.

According to yet another aspect, the ski boot sole comprises: a portion for the toes and ball of the foot, featuring a first bearing region and a second bearing region; and a heel portion featuring a walking area, for contact with the substrate when walking without skis, and a heel contact area for contact with a rear bearing area of a ski binding, i.e. a bearing area in the heel region of the ski binding. With regard to the first bearing region and also the second bearing region, the statements made with respect to the first aspect can also apply to the ski boot sole according to the second aspect, although the feature of the second bearing region which is wider than the first bearing region is only an optional, albeit particularly advantageous feature within the second aspect.

Features of the invention are also described in the aspects formulated below. The aspects are worded in the manner of claims and can substitute for them. Features disclosed in the aspects can also supplement and/or qualify the claims, indicate alternatives with respect to individual features and/or broaden claim features. Bracketed reference signs refer to example embodiments of the invention which are illustrated below in figures. They do not restrict the features described in the aspects to their literal sense as such, but do conversely indicate preferred ways of realising the respective feature.

Aspect 1. A ski boot, comprising a ski boot shell and a ski boot sole (S), wherein the ski boot sole (S) comprises a front end (21) of the ski boot sole, a rear end (31) of the ski boot sole, a lower side (22) of the sole and a free upper side (23) of the sole via which the ski boot sole (S) protrudes forwards and/or backwards and/or laterally beyond the ski boot shell, wherein:

(a) the lower side (22) of the sole comprises a first bearing region (4) for placing upright on a bearing plate (11) of a ski binding (10), and a second bearing region (5) for walking without skis;

(b) the first bearing region (4) is arranged in front of the second bearing region (5), which lies below the ball of the foot of a wearer of the ski boot, in the longitudinal direction (X) of the ski boot;

(c) the second bearing region (5) is curved convexly downwards in the longitudinal direction (X) on the lower side (22) of the sole in order to facilitate a rolling-off movement when walking without skis; and (d) a width (B2) of the ski boot sole (S) in the second bearing region (5) is larger than a width (B1) of the ski boot sole (S) in the first bearing region (4).

Aspect 2. The ski boot according to Aspect 1, wherein the width of a contact area (51) of the second bearing region (5) facing away from the ski boot shell is wider than a contact area (41) of the first bearing region (4) facing away from the ski boot shell.

Aspect 3. The ski boot according to any one of the preceding aspects, wherein: the first bearing region (4) on the lower side (22) of the sole comprises a first contact area (41) for contact with the bearing plate (11) of the ski binding (10); the second bearing region (5) on the lower side (22) of the sole comprises a second contact area (51) for rolling-off contact with the substrate (U) when walking without skis; and the second contact area (51) is wider, transverse to the longitudinal direction (X), than the first contact area (41).

Aspect 4. The ski boot according to Aspect 2 or Aspect 3, wherein the ski boot sole (S) widens constantly in the second bearing region (5) from the upper side (23) of the sole, which is connected to the ski boot shell, up to the contact area (51) facing away from the ski boot shell.

Aspect 5. The ski boot according to the preceding aspect, wherein the contact area (51) facing away from the ski boot shell has outer sides (53) which are arcuate in a plan view onto the lower side (22) of the sole.

Aspect 6. The ski boot according to any one of the preceding aspects, wherein the second bearing region (5) on the lower side (22) of the sole comprises a contact area (51) for a rolling-off contact when walking without skis, and the second bearing region (5) widens downwards in the vertical direction in order to increase the size of its contact area (51).

Aspect 7. The ski boot according to the preceding aspect, wherein the second bearing region (5) widens in the vertical direction immediately up to the contact area (51) of the second bearing region (5).

Aspect 8. The ski boot according to any one of the immediately preceding two aspects, wherein the second bearing region (5) comprises a left-hand side edge extending in the longitudinal direction (X), and a right-hand side edge extending in the longitudinal direction (X), and widens transverse to the longitudinal direction (X) on the left-hand side edge and/or the right-hand side edge, towards the contact area (51).

Aspect 9. The ski boot according to the preceding aspect, wherein the second bearing region (5) widens on each of the left-hand side edge and/or the right-hand side edge immediately up to the contact area (51) of the second bearing region (5).

Aspect 10. The ski boot according to any one of the preceding aspects, wherein the width (B1) of the ski boot sole is 62±2 mm in the first bearing region (4) and/or the width (B2) of the ski boot sole is at least 65 mm in the second bearing region (5).

Aspect 11. The ski boot according to any one of the preceding aspects, wherein the first bearing region (4) comprises a hard component which exhibits a Shore D hardness of at least 45 or at least 50, and/or the second bearing region (5) comprises a soft component which exhibits a Shore A hardness in the range of 70 to 80.

Aspect 12. The ski boot according to any one of the preceding aspects, wherein: the first bearing region (4) on the lower side (22) of the sole comprises a contact area (41) for contact with the bearing plate (11) of the ski binding (10); the second bearing region (5) on the lower side (22) of the sole comprises a contact area (51) for rolling-off contact with the substrate (U) when walking without skis; a first material forms the contact area (41) of the first bearing region (4); a second material forms the contact area (51) of the second bearing region (5); and the first material exhibits a greater hardness, measured as a Shore hardness, than the second material.

Aspect 13. The ski boot according to the preceding aspect, wherein the first material is a first plastic material and/or the second material is a second plastic material, respectively.

Aspect 14. The ski boot according to any one of the immediately preceding two aspects, wherein the first material has a Shore D hardness of at least 45 or at least 50, and/or the second material has a Shore A hardness of at least 70 and at most 80.

Aspect 15. The ski boot according to any one of the preceding aspects, wherein the ski boot sole (S) has an overall length L from the front end (21) of the sole up to the rear end (31) of the sole, and an apical point of the second bearing region (5), in which the ski boot is placed on a level base plane (U) when placed upright, has a distance a from the front end (21) of the sole, wherein the ratio a/L has a value of 0.3±0.05 or 0.3±0.03.

Aspect 16. The ski boot according to any one of the preceding aspects, wherein the first bearing region (4) comprises a contact point or contact line in which the ski boot sole (S) lies on the bearing plate (11) of a ski binding (10) in the first bearing region (4) when the ski boot is held in the binding, wherein the bearing point, bearing line or bearing area has a distance d of 37±7 mm from the front end (21) of the sole.

Aspect 17. The ski boot according to the preceding aspect, wherein when a ski boot is placed on a base plane (U), a vertical distance c which the bearing point, bearing line or bearing area exhibits from the free upper side (23) of the front end (21) of the sole measures 5 mm.

Aspect 18. The ski boot according to Aspect 16 or Aspect 17, wherein when a ski boot is placed on a base plane (U), a vertical distance c which the contact point or contact line of the first bearing region (4) exhibits from the free upper side (23) of the front end (21) of the sole measures 17±1.5 mm or 16.5 mm+1/−0.5 mm.

Aspect 19. The ski boot according to any one of the preceding aspects, wherein when a ski boot is placed on a level base plane (U), a vertical distance b between the free upper side (23) of the front end (21) of the sole and the base plane measures 23 mm±3 mm.

Aspect 20. The ski boot according to any one of the preceding aspects, wherein the first bearing region (4) comprises a contact area (41), which protrudes downwards as an elevation on the lower side (22) of the sole, for contact with the bearing plate (11) of the ski binding (10).

Aspect 21. The ski boot according to the preceding aspect, wherein the contact area (41) of the first bearing region (4) protrudes as an elevation beyond the region of the ski boot sole (S) immediately adjacent to the lower side (22) of the sole by at least 0.5 mm.

Aspect 22. The ski boot according to any one of the preceding aspects, wherein the ski boot sole (S) comprises a separate front sole pad (2) and a separate rear sole pad (3).

Aspect 23. The ski boot according to any one of the preceding aspects, wherein the ski boot sole (S) comprises: a sole base (SB) connected to the ski boot shell; a portion for the toes and ball of the foot; a heel portion; and, on the lower side of the sole base (SB), a front sole pad (2) in the portion for the toes and ball of the foot and a rear sole pad (3) in the heel portion.

Aspect 24. The ski boot according to Aspect 22 or Aspect 23, wherein the front sole pad (2) comprises the first bearing region (4) and the second bearing region (5).

Aspect 25. The ski boot according to at least one of Aspects 22 to 24, wherein the front sole pad (2) and/or the rear sole pad (3) can (respectively) be exchanged.

Aspect 26. The ski boot according to at least one of Aspects 22 to 25, wherein the front sole pad (2) is a multi-component injection-moulded part made of plastic, and the contact area (41) of the first bearing region (4) consists of a first plastic component, and the second bearing region (5) consists of a different, second plastic component at least on the lower side (22) of the sole.

Aspect 27. The ski boot according to at least one of Aspects 22 to 26, wherein the front sole pad (2) including the first bearing region (4) or instead including the second bearing region (5) is an injection-moulded part made of a first plastic, and the other bearing region in each case is moulded along with it, from a different, second plastic, in a multi-component injection-moulding method or is latterly injection-moulded onto the first plastic or joined to the injection-moulded part consisting of the first plastic.

Aspect 28. The ski boot according to any one of the preceding aspects, comprising a heel portion which features a walking area (7), for contact with the substrate when walking without skis, and a heel contact area (8), for placing upright on a rear bearing area of the ski binding, on the lower side (22) of the sole, wherein a material having a first hardness forms the walking area (7), and a material having a second hardness, which is greater than the first hardness, forms the heel contact area (8).

Aspect 29. A ski boot, comprising a ski boot shell and a ski boot sole (S), wherein the ski boot sole (S) comprises a portion for the toes and ball of the foot, a heel portion, a front end (21) of the sole, a rear end (31) of the sole, a lower side (22) of the sole and a free upper side (23) of the sole which protrudes forwards and/or backwards and/or laterally beyond the ski boot shell, wherein (a) the portion for the toes and ball of the foot on the lower side (22) of the sole comprises a first bearing region (4) for placing upright on a bearing plate (11) of a ski binding (10) and, below the ball of the foot of a wearer of the ski boot, a second bearing region (5) for walking without skis;

(b) the first bearing region (4) is arranged in front of the second bearing region (5) in the longitudinal direction (X) of the ski boot;

(c) the second bearing region (5) is curved convexly downwards in the longitudinal direction (X) on the lower side (22) of the sole in order to facilitate a rolling-off movement when walking without skis;

(d) the heel portion features a walking area (7), for contact with the substrate when walking without skis, and a heel contact area (8), for placing upright on a rear bearing area of the ski binding (10), on the lower side (22) of the sole; and (e) a material which forms the heel contact area (8) exhibits a greater hardness, measured as a Shore hardness, than a material which forms the walking area (7).

Aspect 30. The ski boot according to the preceding aspect, wherein the first bearing region (4) on the lower side (22) of the sole comprises a contact area (41) for contact with the bearing plate (11) of the ski binding (10); the second bearing region (5) on the lower side (22) of the sole comprises a contact area (51) for rolling-off contact with the substrate (U) when walking without skis; a first material forms the contact area (41) of the first bearing region (4); a second material forms the contact area (51) of the second bearing region (5); and the first material exhibits a greater hardness, measured as a Shore hardness, than the second material.

Aspect 31. The ski boot according to the preceding aspect, wherein the first material also forms the heel contact area (8), and/or the second material also forms the walking area (7) of the heel portion.

Aspect 32. The ski boot according to any one of Aspects 29 to 31, wherein the heel contact area (8) comprises multiple heel contact partial areas (8*m*, 8*l*, 8*r*) which are separate from each other in a plan view onto the lower side of the sole and are each made of a material having a hardness which is greater than the hardness of the material of the walking area (7).

Aspect 33. The ski boot according to the preceding aspect, wherein a first one of the heel contact partial areas (8*m*, 8*l*, 8*r*) is a middle heel contact partial area (8*m*) as viewed transverse to the longitudinal direction (X) of the ski boot, a second one of the heel contact partial areas (8*m*, 8*l*, 8*r*) is a left-hand heel contact partial area (8*l*) extending on the left alongside the middle heel contact partial area (8*m*), and a third one of the heel contact partial areas (8*m*, 8*l*, 8*r*) is a right-hand heel contact partial area (8*r*) extending on the right alongside the middle heel contact partial area (8*m*).

Aspect 34. The ski boot according to Aspect 32 or Aspect 33, wherein the heel contact area (8) comprises an outer left-hand heel contact partial area (8*l*) and an outer right-hand heel contact partial area (8*r*) which are arranged at a distance from each other, transverse to a central longitudinal axis (X) of the boot, and each at a distance from the central longitudinal axis (X) of the boot.

Aspect 35. The ski boot according to Aspect 33 or Aspect 34, wherein a rear end of the left-hand heel contact partial area (8*l*) and/or a rear end of the right-hand heel contact partial area (8*r*) exhibits a distance $x_4$ of at most 30 mm or at most 27 mm from the rear end (31) of the sole in the longitudinal direction (X) of the ski boot.

Aspect 36. The ski boot according to any one of Aspects 33 to 35, wherein a front end of the left-hand heel contact partial area (8*l*) and/or a front end of the right-hand heel contact partial area (8*r*) has a distance $x_3$ of at least 50 mm or at least 52 mm from the rear end (31) of the sole in the longitudinal direction (X) of the ski boot.

Aspect 37. The ski boot according to any one of Aspects 33 to 36, wherein a front end of the left-hand heel contact partial area (8*l*) and/or a front end of the right-hand heel contact partial area (8*r*) has a distance $x_3$ of at most 60 mm or at most 58 mm from the rear end (31) of the sole in the longitudinal direction (X) of the ski boot.

Aspect 38. The ski boot according to any one of Aspects 32 to 37, wherein the walking area (7) extends between the heel contact partial areas (8*m*, 8*l*, 8*r*) in a plan view onto the lower side (22) of the sole.

Aspect 39. The ski boot according to any one of Aspects 32 to 38, wherein the walking area (7) at least predominantly surrounds an outer circumference of the respective heel contact partial area (8*m*; 8*l*; 8*r*).

Aspect 40. The ski boot according to any one of Aspects 32 to 39, wherein the heel contact partial areas (8*m*, 8*l*, 8*r*) each have a breadth w of at least 5 mm or at least 6 mm and at most 20 mm or at most 10 mm transverse to the longitudinal direction (X) of the ski boot.

Aspect 41. The ski boot according to any one of Aspects 28 to 40, wherein a rear end of the heel contact area (8) has a distance $x_2$, $x_4$ of at least 27 mm and at most 37 mm or at most 28 mm from the rear end (31) of the sole in the longitudinal direction (X) of the ski boot.

Aspect 42. The ski boot according to any one of Aspects 28 to 41, wherein a front end of the heel contact area (8) has a distance $x_1$ of at least 80 mm from the rear end (31) of the sole in the longitudinal direction (X) of the ski boot.

Aspect 43. The ski boot according to any one of Aspects 28 to 42, wherein the heel contact area (8) comprises a left-hand outer periphery and a right-hand outer periphery, and a distance y, measured transverse to the longitudinal direction (X) of the ski boot, which the left-hand outer periphery and right-hand outer periphery exhibit from each other measures at least 50 mm or at least 52 mm and at most 60 mm or at most 57 mm.

Aspect 44. The ski boot according to any one of Aspects 28 to 43, wherein the material which forms the walking area (7) exhibits a Shore A hardness of at least 70 and at most 80, and/or the material which forms the heel contact area (8) exhibits a Shore D hardness of at least 45 or at least 50.

Aspect 45. The ski boot according to any one of Aspects 28 to 44, wherein the material which forms the walking area (7) is a plastic, and/or the material which forms the heel contact area (8) is a plastic.

Aspect 46. The ski boot according to any one of Aspects 28 to 45, wherein the walking area (7) and the heel contact area (8) are configured in terms of size in the plan view onto the lower side (22) of the sole and in terms of vertical length in the side view such that when placed upright on the rear bearing area of the ski binding, predominantly or only the heel contact area (8) is in contact with the bearing area of the ski binding, and when the ski boot is placed upright onto a base plane (U), predominantly the walking area (7) is in contact with the base plane (U).

Aspect 47. The ski boot according to any one of Aspects 28 to 46, wherein the heel contact area (8) is at least 5 $cm^2$ in size.

Aspect 48. The ski boot according to any one of the preceding aspects, wherein the ski boot is a children's ski boot.

Aspect 49. A sole pad for a children's ski boot, wherein the sole pad (2) can be connected to a front region of the children's ski boot, and wherein a lower side (22) of the sole pad comprises a first bearing region (4) for placing upright on a bearing plate of a ski binding, and a second bearing region (5) for walking in the children's ski boot without skis, wherein a width of the sole pad (2) is larger in the second bearing region (5) than a width of the sole pad (2) in the first bearing region (4).

Aspect 50. The sole pad according to the preceding aspect, wherein the sole pad (2) comprises the first bearing region (4) and the second bearing region (5)

exhibiting one or more of the features which are disclosed for these bearing regions (4, 5) by at least one of Aspects 1 to 48 and/or the description and/or by at least one of the figures.

In the following, the invention is described in more detail on the basis of figures by way of example, without thereby restricting the subject-matter of the invention to the example embodiment. Features which can only be gathered from the figures form part of the scope of the invention and can advantageously develop the subject-matter of the invention, individually and in any combination.

Figure 2:
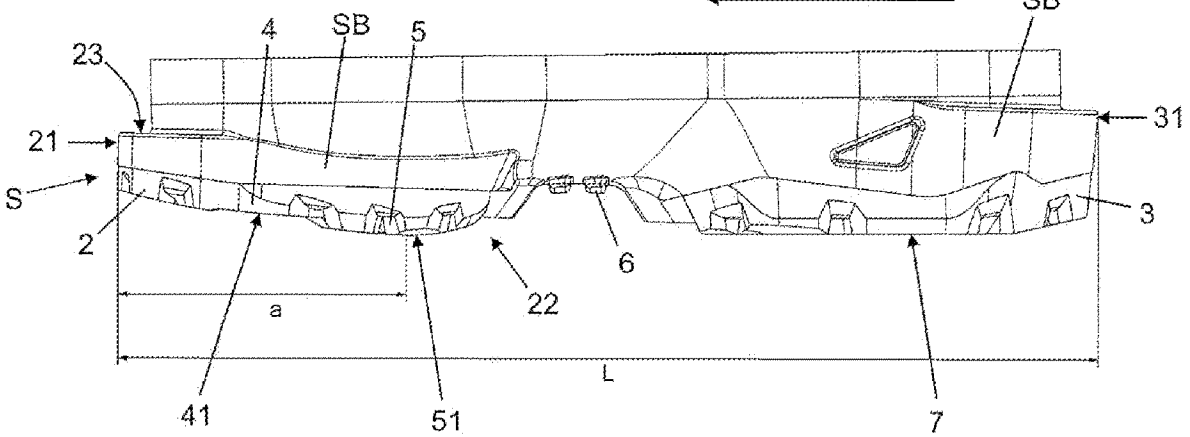
Figure 3:
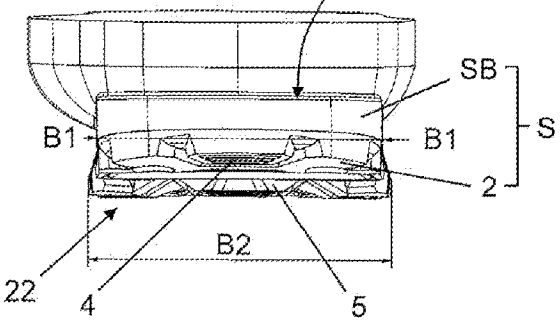
Figure 4:
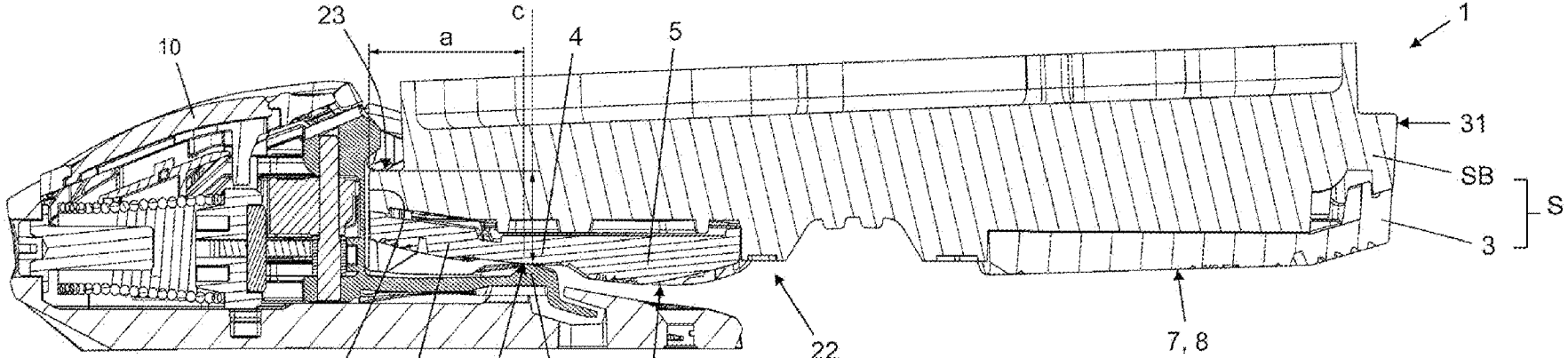
Figure 5:
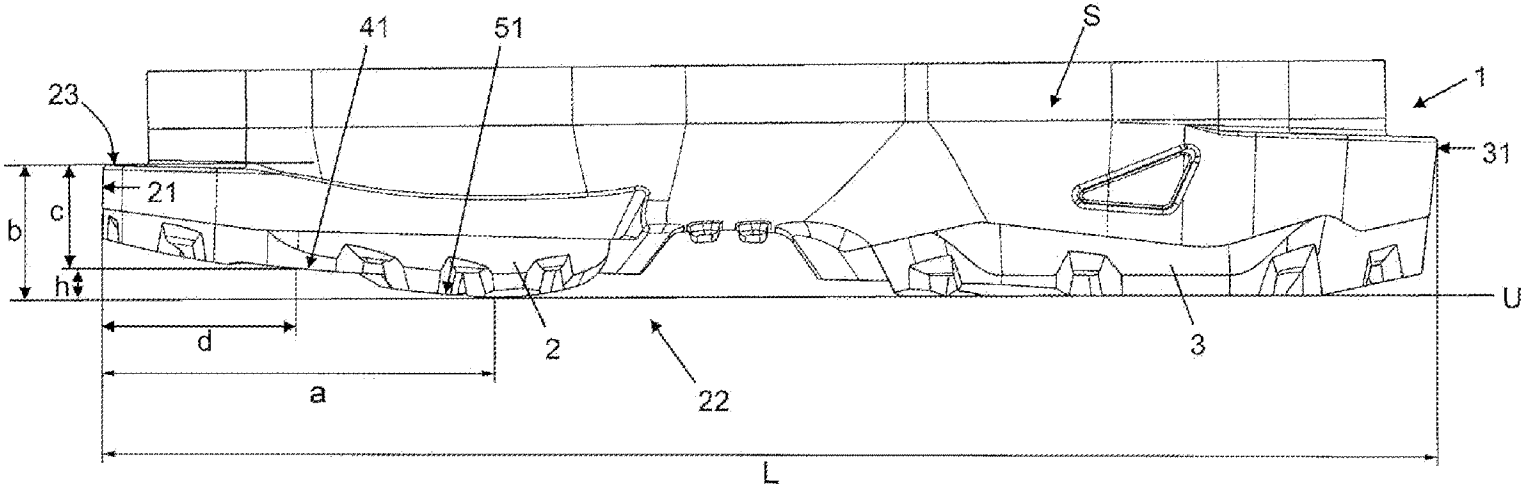
Figure 6:
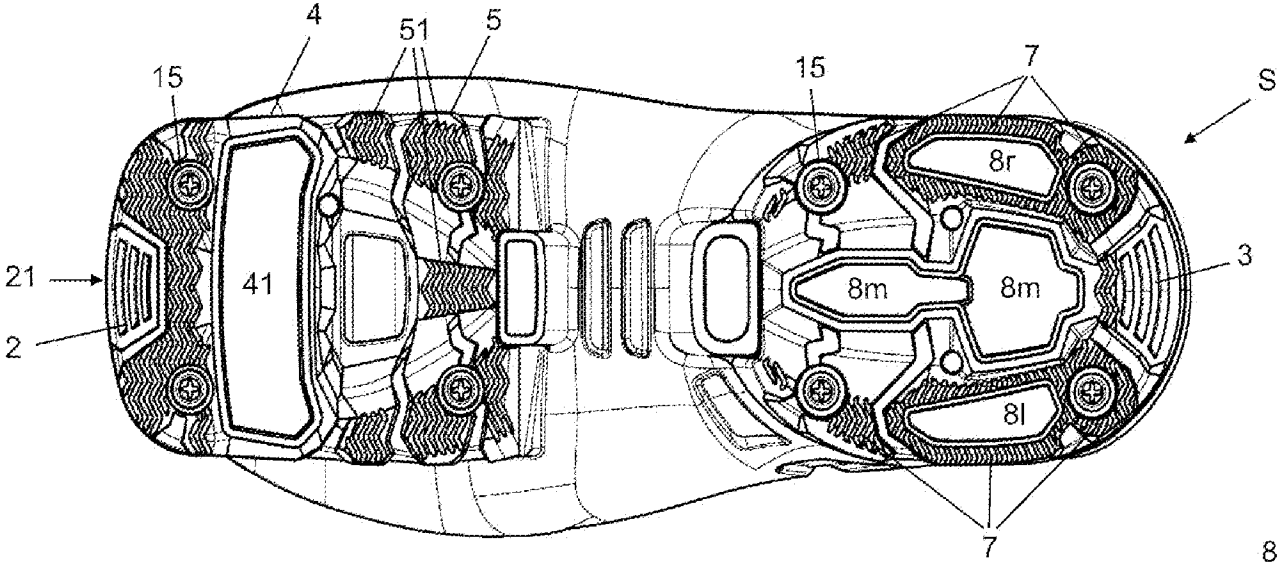
Figure 7:
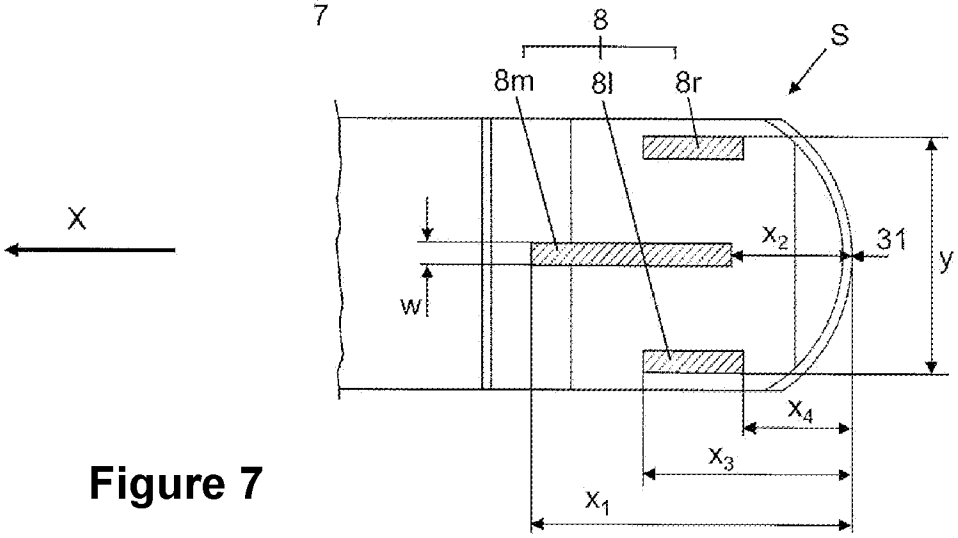

The individual figures show:

FIG. 1 a view of a ski boot from below;

FIG. 2 a view of a sole region of the ski boot from the side;

FIG. 3 a view of a lower region of the ski boot from the front;

FIG. 4 a sectional view of the ski boot sole of FIG. 1, held in a ski binding, from the side;

FIG. 5 the side view of FIG. 2, with additional measurement details of the length and height dimensions of the ski boot sole;

FIG. 6 the ski boot of FIG. 1 in another plan view onto the lower side of the sole; and FIG. 7 a plan view onto a heel portion of a ski boot, with measurement details of the length and width dimensions.

FIG. 1 shows a view from below onto the sole S of a ski boot 1, in particular a ski boot for children. FIG. 2 shows the ski boot sole S in a side view. The sole S is specifically embodied to improve walking in the ski boot 1 without skis.

The ski boot sole S consists of a sole base SB (FIG. 2), a front sole pad 2 and a rear sole pad 3 which are each arranged on the lower side of the sole base SB. In the example embodiment, the front sole pad 2 is formed separately from the rear sole pad 3, and each of the two sole pads 2 and 3 is connected separately to the ski boot 1, i.e. to the sole base SB, wherein the front sole pad 2 can be detachably connected to the ski boot 1 such that it can be exchanged for another sole pad, for example because of wear, damage or in order to adapt the ski boot 1 to a specific ski binding. The front sole pad 2 and/or the rear sole pad 3 can then each be screwed to the sole base SB by means of multiple fastening means 15, for example fastening screws 15.

Both sole pads 2, 3 exhibit a profile in order to ensure a firm grip when walking in the ski boot 1 without skis in snow or on an icy surface. The front sole pad 2 comprises a bearing region 4, which is a first bearing region as viewed from a front end 21 of the ski boot sole, and a second bearing region 5, wherein the first bearing region 4 is embodied between the front end 21 of the sole and the second bearing region 5 in the longitudinal direction X of the boot, i.e. the first bearing region 4 is formed in the region of the toes of the user of the ski boot 1 or slightly further back, and the second bearing region 5 is formed in the region of the ball of the foot.

The first bearing region 4 is designed to support the ski boot 1, which is held in a binding, on a bearing plate 11 of a ski binding 10 (see FIG. 4), while at the same time, the second bearing region 5 preferably does not contact either parts of the ski binding 10 or the ski itself. The second bearing region 5 is optimised for walking in the ski boot 1 without skis. When a ski boot 1 is placed upright on a level area (a base plane), only the second bearing region 5 of the front sole pad 2—for example, only a point or line or area of the second bearing region 5—lies on the base plane of the front sole pad 2. As described further below, the front sole pad 2 is shaped such that the user can roll off as usual in the region of the second bearing region 5 when walking in the ski boot 1 without skis. An intermediate portion of the sole S extending between the front sole pad 2 and the rear sole pad 3 can be designed to assist rolling off with one's foot when walking without skis, for example by enabling the intermediate portion to elastically deform, for example flex, during rolling off.

In the example embodiment, the portion between the front sole pad 2 and the rear sole pad 3 comprises reinforcing ribs 6 which are arranged transverse to the longitudinal direction X of the ski and spaced from each other. In the example embodiment, two reinforcing ribs 6 extending transverse to the longitudinal direction X of the ski are formed on the lower side of the ski boot sole S. In modifications, it is also possible for only one reinforcing rib 6 to be formed between the sole pads 2 and 3. In other modifications, however, it is also possible for more than two reinforcing ribs 6, for example three or four reinforcing ribs 6, extending transverse to the longitudinal direction X of the ski and axially spaced from each other, to be formed on the lower side of the ski boot sole S. Forming one or more reinforcing ribs 6 on the lower side of the sole can improve the grip of the ski boot when walking in snow and slush.

The lower side 22 of the sole is vertically retracted in the intermediate portion as compared to the heel portion and the first bearing region 4 and second bearing region 5, such that when the ski boot is held in the ski binding and therefore fastened to the ski, it is not in contact with the ground in the intermediate portion. When placed upright on a base plane, the ski boot is likewise not in contact with the base plane in the intermediate portion.

As can be seen in FIG. 1, a width B1—measured transverse to the longitudinal axis X—of the front sole pad 2 is smaller in the region of the first bearing region 4 than a width B2—measured transverse to the longitudinal axis X—in the region of the second bearing region 5. A contact area 51 of the second bearing region 5 which lies on the base plane or on the ground is therefore wider, thus increasing the level of safety when walking without skis. The profile of the front sole pad 2 can have a concave shape in a width direction transverse to the longitudinal direction X and can for example be indented in a middle region. In order to increase or further increase the width of the contact area 51, the profile of the second bearing region 5 can be embodied such that at least individual parts of the profile are elastically deformed when a weight is applied from above, thus further increasing the width of the contact area 51. The pressure of the weight of the wearer of the ski boot can then for example elastically deform at least the lateral peripheral regions of the sole pad 2 outwards, i.e. away from a central longitudinal axis of the ski boot 1, transverse to the longitudinal direction X of the second bearing region 5.

The second bearing region 5 can consist of or comprise a relatively soft material which for example exhibits a Shore A hardness of between 70 and 80. The first bearing region 4, which should exhibit no or only very little elastic deformation, can be formed from or comprise a material which exhibits a Shore D hardness of at least or more than 40 or at least or more than 45 and preferably at least or more than 50. The first and second bearing regions 4, 5 are preferably formed from one or more plastics. Materials, or at least proportions of materials, other than plastic—such that for example glass, ceramics, metal—for the first bearing region 4 in particular and, although less preferred, for the second bearing region 5 are however not excluded but rather also encompassed by the scope of the invention. The second bearing region 5 can then for example consist of a thermoplastic polyurethane, i.e. TPU.

FIG. 2 shows a lateral view of a lower part of the ski boot 1 of FIG. 1. FIG. 2 shows the ski boot 1 placed upright on a horizontal base plane. The ski boot sole S has a free front end 21 of the ski boot sole, comprising a free upper side 23 of the sole, and a rear end 31 of the ski boot sole, likewise comprising a free upper side of the sole. The free upper side 23 of the sole and the free upper side of the sole at the end 31 of the sole are used for clamping the ski boot 1 by means of a ski binding. Sole retainers of a front jaw and sole retainers of a rear jaw of the ski binding can then clamp the ski boot 1 downwards, via the free front upper side 23 of the sole and the free rear upper side of the sole, against the respective bearing area of the binding and thus against the ski. The lower side 22 of the sole is substantially formed by the front sole pad 2 and the rear sole pad 3, which in the example embodiment are two separate sole pads 2 and 3 which are also not connected directly to each other but are rather axially spaced from each other by the retracted intermediate portion. In the example shown, both sole pads 2, 3 have a pronounced profile which improves the grip of the ski boot 1 or, respectively, the ski boot sole S when walking without skis, as compared to ski boot soles with no profile.

The front sole pad 2 comprises the first bearing region 4, which features a contact area 41, and the second bearing region 5 which features the contact area 51. In modifications, the first bearing region 4 can comprise only a contact line or one or more contact points, instead of a two-dimensional contact area 41. The contact area 51 is understood to be the area on the lower side of the second bearing region 5 which rolls off on the base plane during a natural rolling-off movement when walking in the ski boot. When merely placed upright on the base plane, the contact area 51 of the unburdened ski boot, which is placed upright and only exerts its own weight, can be almost linear or even punctiform, in particular if the contact area 51 is formed by rib-shaped or nub-shaped protrusions on the lower side of the ski boot sole S.

In order to facilitate the rolling-off movement, the second bearing region 5 of the sole pad 2 is convex—in the example, rounded outwards—in the longitudinal direction X on the lower side. This does not conflict with the fact that a concave curvature in a direction transverse to the longitudinal direction X of the boot can be embodied in the same region.

The second bearing region 5 or, respectively, the contact area 51 has a distance a from the front end 21 of the sole, at an overall length L of the ski boot sole S, wherein the overall length L is measured between the front end 21 of the sole and the rear end 31 of the sole. The distance a is the distance between an apical point or apical line of the contact area 51 and the front end 21 of the sole. A ratio of the distance a to the length L preferably has a value of 0.3±0.1, preferably 0.3±0.05 and particularly preferably 0.3±0.03, i.e. the position of the ball of the foot or the contact point of the front sole pad 2 is 30% of the length L of the ski boot sole S short of the front end 21 of the ski boot sole, plus or minus the corresponding tolerances. If the length of the sole is 217 mm (a children's boot), the contact area 51 will thus for example be 65 mm±5 mm short of the front end 21 of the sole.

FIG. 3 shows the sole region of the ski boot 1 of FIG. 1, in an axial view from the front. The profile of the front sole pad 2, the first bearing region 4 and at least the front part of the second bearing region 5 can again be seen. The second bearing region 5 or, respectively, the profile in the second bearing region 5, i.e. the silhouette of the second bearing region 5, is convex transverse to the longitudinal direction X, i.e. in the plane of the figure, in relation to the base plane. If a weight is applied which acts on the sole S from above, an area of the profile which contacts the base plane can be increased in the second bearing region 5 due to elastic deformation of the profile, if the latter can be elastically deformed.

In accordance with the invention, the width or a maximum width B2 of the second bearing region 5 is larger than the width or maximum width B1 of the first bearing region 4. The width or maximum width B1 can then be predetermined by the corresponding standard and measure 62±2 mm, while the width or maximum width B2 has a value of at least 65 mm or at least 66 mm, for example 67 mm. Values over 67 mm are less preferred but are likewise encompassed by the invention.

The contact area 41 of the first bearing region 4 is exposed on the lower side 22 of the front sole pad 2. It is thus a contact area 41 which protrudes downwards as an elevation. The contact area 41 can protrude beyond the region of the front sole pad 2 immediately adjacent to the contact area 41 on the lower side 22 of the sole, in particular by at least 0.5 mm.

The contact area 41 can be formed by a contact structure which is formed from a material, for example a plastic, which exhibits a greater hardness, measured as a Shore hardness, than a material which forms the second bearing region 5 and/or the entire remainder of the front sole pad 2. The two materials having a different hardness can in particular each be a plastic, wherein the plastic which forms the second bearing region 5 or which expediently forms the front sole pad 2 except for the contact structure mentioned exhibits a hardness which is for example in the Shore A range. The plastic which forms the contact structure featuring the contact area 41 exhibits a comparatively greater hardness, for example a hardness in the Shore D range.

In the heel portion, the ski boot sole S features a walking area 7, for contact with the substrate when walking without skis, and a heel contact area 8 for contact with a bearing area in the rear longitudinal region of the ski binding 10, on the lower side 22 of the sole. The rear sole pad 3 forms the areas 7 and 8 on its lower side, wherein the heel contact area 8 is formed from a material which exhibits a greater hardness, measured as a Shore hardness, than a material which forms the walking area 7. The heel contact area 8 can in particular be formed from the same material as the contact area 41 of the first bearing region 4. Otherwise, the rear sole pad 3 including the walking area 7 can be formed from the material which also forms the second bearing region 5.

The heel contact area 8 comprises multiple heel contact partial areas, namely a middle heel contact partial area **8*m*, a left-hand heel contact partial area 8*l* and a right-hand heel contact partial area 8*r*. In the example embodiment, the two outer heel contact partial areas 8*l* and 8*r* each exhibit a distance, measured transverse to the longitudinal direction X, from the middle heel contact partial area 8*m*. A partial area of the walking area 7 extends between the middle heel contact partial area 8*m* and the left-hand heel contact partial area 8*l*, and another partial area of the walking area 7 extends between the middle heel contact partial area 8*m* and the right-hand heel contact partial area 8*r*, respectively. The heel contact partial areas 8*m*, 8*l*, 8*r* are thus separate from each other and separated from each other by the walking area 7. In modifications, the heel contact partial area 8*m* can however also be combined with the heel contact partial area 8***l* and/or with the heel contact partial area 8*r* to form a contiguous heel contact area.

FIG. 4 shows a longitudinal section of the sole S in the axial region of the first sole pad 2, wherein the ski boot 1 is held in a ski binding 10. The ski binding 10 can comprise pivoting sole retainers, pins or other securing means known in the prior art, in order to hold the ski boot. The ski binding 10 comprises a bearing plate 11 which is arranged and shaped such that the sole S is supported on the bearing plate 11 via the first bearing region 4 or, respectively, the bearing area 41 when the binding 10 is closed. A wedge-shaped hollow space is formed behind the bearing plate 11 and delineated axially forwards by a rear end of the bearing plate 11, downwards by the surface of the ski or the binding 10 and upwards by the second bearing region 5.

FIG. 5 shows the sole region of the ski boot 1 in the same side view as in FIG. 1. In FIG. 5, the ski boot, i.e. the ski boot sole S, is placed upright on a level substrate, i.e. the base plane U.

Measurements which substantially follow from the applicable DIN ISO 5355 standard for ski boots, in particular children's ski boots, shall be briefly mentioned for the sake of completeness. Tolerance values are also mentioned in the standard which form part of the scope of the invention. Measurements which are outside the values predetermined in the standard and correspond to at most the value in the standard plus three times the tolerance are likewise encompassed, wherever other measurements or values or tolerances are not mentioned in the description.

The free upper side 23 of the front end 21 of the ski boot sole can in particular have a perpendicular distance b from the base plane U of 23±3 mm. This corresponds to the vertical distance which the apical point or an apical line or apical area region of the contact area 51 of the second bearing region 5 exhibits from the free upper side 23 of the front end 21 of the sole when placed upright on the base plane U with no load. A perpendicular distance c between the contact area 41 of the first bearing region 4 on the bearing plate 11 (FIG. 4) and the free upper side 23 of the front end 21 of the ski boot sole can in particular measure 17±3 mm or 16.5±1.5 mm. The contact area 41 of the first bearing region 4 which lies on the bearing plate 11 in the closed ski binding 10 can have a distanced of in particular 28 mm to 48 mm and preferably 30 mm to 44 mm from the front end 21 of the ski boot sole. When a ski boot 1 is placed upright on the base plane U, the lower side 22 of the sole can have a distance h of at least 5 mm from the base plane U, from the front end 21 of the ski boot sole up to and into the first bearing region 4, across a length of 40±10 mm or 33±7 mm.

FIG. 6 again shows the ski boot sole S in the plan view onto the lower side of the sole, corresponding to FIG. 1. As can be seen in FIG. 6, the ski boot sole S can exhibit fluting on the lower side in the region of the areas which contact or can contact the substrate when walking without skis, in order to improve the grip when walking on a smooth substrate or in snow or slush. The areas which are fluted on the lower side are the contact area 51 of the second bearing region 5 and the walking area 7 of the heel portion as well as a front contact area which lies between the front end 21 of the sole and the contact area 41 of the first bearing region 4. In the heel portion, the fluted walking area 7 surrounds the two outer heel contact partial areas 8*l* and 8*r* laterally on the outside and also laterally on the inside, towards the middle heel contact partial area 8*m*. In the example embodiment, the fluted walking area 7 surrounds the two lateral heel contact partial areas 8*l* and 8*r* completely. Fluting, while advantageous, is only optional.

With respect to the contact areas 41 and 8 and/or the contact partial areas 8*m*, 8*l* and 8*r*, it should also be noted that said contact partial areas are formed on the lower sides of plate-shaped or bowl-shaped contact structures and that these contact structures are arranged, for example embedded, in the comparatively softer plastic material which forms the sole pads 2 and 3 except for the contact structures.

The heel contact area 8—in the example embodiment, the heel contact partial areas 8*m*, 8*l* and 8*r*—can protrude downwards slightly, i.e. by a tenth or a few tenths of a millimetre, beyond the walking area 7 or instead be slightly short of the walking area 7. In advantageous embodiments, however, the heel contact area 8—in the example embodiment, its partial areas 8*m*, 8*l* and 8*r*—is situated level with the immediately adjacent area regions of the walking area 7. Favourable release properties on the one hand, and pleasant walking properties on the other, are achieved by appropriately choosing the area ratio between the walking area 7 and the heel contact area 8. The rear bearing area of the ski binding can comprise elevated bearing area regions in line with the division of the heel contact area 8 into heel contact partial areas, in accordance with their arrangement and/or shape, such that when the ski boot is held in the ski binding, only its heel contact partial areas 8*m*, 8*l* and 8*r* are placed on the rear bearing area of the ski binding, i.e. are in contact with the rear bearing area.

FIG. 7 is a plan view onto the lower side of the heel portion. In FIG. 7, measurements for the positions of the heel contact partial areas 8*m*, 8*l* and 8*r* and measurements for minimum dimensions of the individual heel contact partial areas 8*m*, 8*l* and 8*r* are specified. The heel contact partial areas 8*m*, 8*l* and 8*r* are each shown as elongated rectangular strips, wherein the rectangular strips each represent a minimum area for the corresponding heel contact partial area.

The heel contact partial areas can each for example comprise a breadth w, measured transverse to the longitudinal direction X, of at least 5 mm or at least 6 mm. Conversely, it is advantageous if the breadth w of the respective heel contact partial area measures no more than 20 mm or at most 10 mm. In advantageous embodiments, the heel contact area 8 as a whole exhibits a size of at least 5 $cm^2$.

A front end of the middle heel contact partial area 8*m* can have a distance $x_1$, measured in the longitudinal direction X, of for example at least 80 mm from the rear end 31 of the sole. A rear end of the middle heel contact partial area 8*m* exhibits a distance $x_2$, measured in the longitudinal direction X, from the rear end 31 of the sole, wherein in advantageous embodiments, said distance $x_2$ measures at most 37 mm or at most 30 mm, better yet at most 28 mm. The rear ends of the lateral heel contact partial areas 8*l* and 8*r* can exhibit a distance $x_4$, measured in the longitudinal direction X, of at least 27 mm and/or at most 30 mm from the rear end 31 of the sole. The distance $x_2$ is advantageously larger than the distance $x_4$. The front ends of the lateral heel contact partial areas 8*l* and 8*r* advantageously exhibit a distance $x_3$, as measured in the longitudinal direction X, from the rear end 31 of the sole, wherein the distance $x_3$ is smaller than $x_1$. The lateral heel contact partial areas 8*l* and 8*r* are advantageously shorter in the longitudinal direction X of the boot than the middle heel contact partial area 8*m*.

In advantageous embodiments, the heel contact area 8 exhibits a maximum width y, transverse to the longitudinal direction X, which is measured from the outer side edge of the left-hand heel contact partial area 8*l* to the outer side edge of the right-hand heel contact partial area 8*r* and can in particular measure at least 50 mm or at least 52 mm. The maximum width y can in particular measure at most 60 mm or at most 57 mm.

The heel contact partial areas 8*m*, 8*l* and 8*r* can be mirror-symmetrical with respect to a central longitudinal axis X of the ski boot 1. If the heel contact area 8 is formed as a contiguous contact area, by connecting the heel contact partial areas to form a contiguous heel contact area, then this contiguous heel contact area 8 is likewise mirror-symmetrical with respect to the central longitudinal axis X of the ski boot 1 in advantageous embodiments. The details of a maximum width y and the distances from the rear end 31 of the sole also apply to a contiguous heel contact area 8.

The invention claimed is:

1. A combination of a ski boot, a ski binding and a ski, wherein the ski boot, comprises a ski boot shell and a ski boot sole, and wherein the ski boot sole comprises a front end of the ski boot sole, a rear end of the ski boot sole, a lower side of the sole and a free upper side of the sole via which the ski boot sole protrudes forwards and/or backwards and/or laterally beyond the ski boot shell, wherein:

(a) the lower side of the sole comprises a first bearing region for placing upright on a bearing plate of the ski binding, and a second bearing region for walking without skis;

(b) the first bearing region is arranged in front of the second bearing region, which lies below the ball of the foot of a wearer of the ski boot, in the longitudinal direction of the ski boot;

(c) the second bearing region is curved convexly downwards in the longitudinal direction on the lower side of the sole in order to facilitate a rolling-off movement when walking without skis; and (d) a width of the ski boot sole in the second bearing region is larger than a width of the ski boot sole in the first bearing region, (e) wherein the second bearing region widens downwards in the vertical direction in order to increase the size of its contact area, and (f) wherein the first bearing region is designed to support the ski boot, which is held in a binding, on the bearing plate of the ski binding, while at the same time, the second bearing region does not contact either parts of the ski binding or the ski itself.

2. The combination according to claim 1, wherein the width of a contact area of the second bearing region facing away from the ski boot shell is wider than a contact area of the first bearing region facing away from the ski boot shell.

3. The combination according to claim 1, wherein the width of the ski boot sole is 62±2 mm in the first bearing region and/or the width of the ski boot sole is at least 65 mm in the second bearing region.

4. The combination according to claim 1, wherein: the first bearing region on the lower side of the sole comprises a contact area for contact with the bearing plate of the ski binding; the second bearing region on the lower side of the sole comprises a contact area for rolling-off contact with the substrate when walking without skis; a first material forms the contact area of the first bearing region; a second material forms the contact area of the second bearing region; and the first material exhibits a greater hardness, measured as a Shore hardness, than the second material.

5. The combination according to claim 4, wherein the first material has a Shore D hardness of at least 45, and/or the second material has a Shore A hardness of at least 70 and at most 80.

6. The combination according to claim 1, wherein the ski boot sole has an overall length L from the front end of the sole up to the rear end of the sole, and an apical point of the second bearing region, in which the ski boot is placed on a level base plane when placed upright, has a distance a from the front end of the sole, wherein the ratio a/L has a value of 0.3±0.05.

7. The combination according to claim 1, wherein the first bearing region comprises a contact point or contact line in which the ski boot sole lies on the bearing plate of a ski binding in the first bearing region when the ski boot is held in the binding, wherein a bearing point or a bearing line has a distance d of 37±7 mm from the front end of the sole.

8. The combination according to claim 7, wherein when a ski boot is placed on a base plane, a vertical distance c which the contact point or contact line of the first bearing region exhibits from the free upper side of the front end of the sole measures 17±1.5 mm.

9. The combination according to claim 1, wherein when a ski boot is placed on a level base plane, a vertical distance b between the free upper side of the front end of the sole and the base plane measures 23 mm±3 mm.

10. The combination according to claim 1, wherein the first bearing region comprises a contact area, which protrudes downwards as an elevation on the lower side of the sole, for contact with the bearing plate of the ski binding.

11. The combination according to claim 1, wherein the ski boot sole comprises: a sole base connected to the ski boot shell; a portion for the toes and ball of the foot; a heel portion; and, on the lower side of the sole base, a front sole pad in the portion for the toes and ball of the foot and a rear sole pad in the heel portion.

12. The combination according to claim 11, wherein the front sole pad comprises the first bearing region and the second bearing region.

13. The combination according to claim 1, comprising a heel portion which features a walking area, for contact with the substrate when walking without skis, and a heel contact area, for placing upright on a rear bearing area of the ski binding, on the lower side of the sole, wherein a material having a first hardness forms the walking area, and a material having a second hardness, which is greater than the first hardness, forms the heel contact area.

14. A ski boot, comprising a ski boot shell and a ski boot sole, wherein the ski boot sole comprises a portion for the toes and ball of the foot, a heel portion, a front end of the sole, a rear end of the sole, a lower side of the sole and a free upper side of the sole which protrudes forwards and/or backwards and/or laterally beyond the ski boot shell, wherein (a) the portion for the toes and ball of the foot on the lower side of the sole comprises a first bearing region for placing upright on a bearing plate of a ski binding and, below the ball of the foot of a wearer of the ski boot, a second bearing region for walking without skis;

(b) the first bearing region is arranged in front of the second bearing region in the longitudinal direction of the ski boot;

(c) the second bearing region is curved convexly downwards in the longitudinal direction on the lower side of the sole in order to facilitate a rolling-off movement when walking without skis;

(d) the heel portion features a walking area, for contact with the substrate when walking without skis, and a heel contact area, for placing upright on a rear bearing area of the ski binding, on the lower side of the sole; and (e) a material which forms the heel contact area exhibits a greater hardness, measured as a Shore hardness, than a material which forms the walking area (f) wherein the heel contact area comprises multiple heel contact partial areas, and wherein a first one of the heel contact partial areas is a middle heel contact partial area, a second one of the heel contact partial areas is a left-hand heel contact partial area, and a third one of the heel contact partial areas is a right-hand heel contact partial area;

(g) wherein the rear end of the left-hand heel contact partial area and/or the rear end of the right-hand heel contact partial area has a distance $x_4$ of at most 30 mm from the rear end of the sole in the longitudinal direction of the ski boot, and wherein the heel contact area has a maximum width y of at most 60 mm transverse to the longitudinal direction of the ski boot, and wherein a front end of the middle heel contact partial area has a distance of at least 80 mm from the rear end of the sole in the longitudinal direction.

15. The ski boot according to claim 14, wherein a rear end of the left-hand heel contact partial area and/or a rear end of the right-hand heel contact partial area has a distance $x_4$ of at most 30 mm from the rear end of the sole in the longitudinal direction of the ski boot.

16. The ski boot according to claim 14, wherein a front end of the left-hand heel contact partial area and/or a front end of the right-hand heel contact partial area has a distance $x_3$ of at least 50 mm and of at most 60 mm from the rear end of the sole in the longitudinal direction of the ski boot.

17. The ski boot according to claim 14, wherein the heel contact partial areas each have a breadth w of at least 5 mm and at most 20 mm transverse to the longitudinal direction of the ski boot.

18. A sole pad for a children's ski boot, wherein the sole pad can be connected to a front region of the children's ski boot, and wherein a lower side of the sole pad comprises a first bearing region for placing upright on a bearing plate of a ski binding, and a second bearing region for walking in the children's ski boot without skis, wherein (a) the first bearing region is arranged in front of the second bearing region, which lies below the ball of the foot of a wearer of the ski boot, in the longitudinal direction of the ski boot, when the sole pad is connected to the children's ski boot;

(b) the second bearing region is curved convexly downwards in the longitudinal direction on the lower side of the sole pad in order to facilitate a rolling-off movement when walking without skis; and (c) a width of the sole pad is larger in the second bearing region than a width of the sole pad in the first bearing region, (d) and wherein the second bearing region widens downwards in the vertical direction in order to increase the size of its contact area;

(e) wherein the first bearing region comprises a contact area, which protrudes downwards as an elevation on the lower side of the sole pad, for contact with the bearing plate of the ski binding;

(f) wherein the front sole pad including the first bearing region or instead including the second bearing region is an injection-moulded part made of a first plastic, and the other bearing region in each case is moulded along with it, from a different, second plastic, in a multi-component injection-moulding method or is latterly injection-moulded onto the first plastic.

19. A sole pad for a children's ski boot wherein the sole pad can be connected to a rear region of the children's ski boot, and wherein a lower side of the sole pad comprises (a) a walking area, for contact with the substrate when walking without skis, and a heel contact area, for placing upright on a rear bearing area of the ski binding, on the lower side of the sole pad;

wherein:

(b) a material which forms the heel contact area exhibits a greater hardness, measured as a Shore hardness, than a material which forms the walking area; and (c) wherein the heel contact area comprises multiple heel contact partial areas which are separate from each other or are combined to form a contiguous heel contact area in a plan view onto the lower side of the sole pad and are each made of a material having a hardness which is greater than the hardness of the material of the walking area and wherein a first one of the heel contact partial areas is a middle heel contact partial area, a second one of the heel contact partial areas is a left-hand heel contact partial area, and a third one of the heel contact partial areas is a right-hand heel contact partial area, and wherein a partial area of the walking area extends between the middle heel contact partial area and the left-hand heel contact partial area, and another partial area of the walking area extends between the middle heel contact partial area and the right-hand heel contact partial area;

(d) wherein the rear end of the left-hand heel contact partial area and/or the rear end of the right hand heel contact partial area has a distance x4 of at most 30 mm from the rear end of the sole in the longitudinal direction of the ski boot when the sole pad is connected to the children's ski boot, and wherein the heel contact area has a maximum width y of at most 60 mm transverse to the longitudinal direction of the ski boot, and wherein a front end of the middle heel contact partial area has a distance of at least 80 mm from the rear end of the sole in the longitudinal direction.

20. A ski boot, comprising a ski boot shell and a ski boot sole, wherein the ski boot sole comprises a portion for the toes and ball of the foot, a heel portion, a front end of the sole, a rear end of the sole, a lower side of the sole and a free upper side of the sole which protrudes forwards and/or backwards and/or laterally beyond the ski boot shell, wherein (a) the portion for the toes and ball of the foot on the lower side of the sole comprises a first bearing region for placing upright on a bearing plate of a ski binding and, below the ball of the foot of a wearer of the ski boot, a second bearing region for walking without skis;

(b) the first bearing region is arranged in front of the second bearing region in the longitudinal direction of the ski boot;

(c) the second bearing region is curved convexly downwards in the longitudinal direction on the lower side of the sole in order to facilitate a rolling-off movement when walking without skis;

(d) the heel portion features a walking area, for contact with the substrate when walking without skis, and a heel contact area, for placing upright on a rear bearing area of the ski binding, on the lower side of the sole; and (e) a material which forms the heel contact area exhibits a greater hardness, measured as a Shore hardness, than a material which forms the walking area;

(f) wherein the first bearing region on the lower side of the sole comprises a contact area for contact with the bearing plate of the ski binding; the second bearing region on the lower side of the sole comprises a contact area for rolling-off contact with the substrate when walking without skis; a first material forms the contact area of the first bearing region; a second material forms the contact area of the second bearing region; and the first material exhibits a greater hardness, measured as a Shore hardness, than the second material; and (g) wherein the contact area of the first bearing region protrudes downwards as an elevation on the lower side of the sole pad, for contact with the bearing plate of the ski binding.

* * * * *